US009093248B2

(12) United States Patent
Putterman et al.

(10) Patent No.: US 9,093,248 B2
(45) Date of Patent: Jul. 28, 2015

(54) TRIBOELECTRIC X-RAY SOURCE

(75) Inventors: Seth J. Putterman, Malibu, CA (US); Jonathan Hird, Cambridge (GB); Carlos Camara, Venice, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 118 days.

(21) Appl. No.: 14/003,227

(22) PCT Filed: Mar. 9, 2012

(86) PCT No.: PCT/US2012/028581

§ 371 (c)(1), (2), (4) Date: Sep. 4, 2013

(87) PCT Pub. No.: WO2012/125492

PCT Pub. Date: Sep. 20, 2012

(65) Prior Publication Data

US 2013/0343526 A1 Dec. 26, 2013

Related U.S. Application Data

(60) Provisional application No. 61/451,694, filed on Mar. 11, 2011.

(51) Int. Cl.

| | |
|---|---|
| ***G21G 4/00*** | (2006.01) |
| ***H01J 35/16*** | (2006.01) |
| ***H01J 35/02*** | (2006.01) |

(52) U.S. Cl.

CPC *H01J 35/16* (2013.01); *H01J 35/02* (2013.01)

(58) Field of Classification Search

CPC ..... H01J 35/02; H01J 35/08; H01J 35/16; H01J 2235/081; H01J 2235/088

USPC ..... 378/119, 121, 123, 143

See application file for complete search history.

(56) References Cited

U.S. PATENT DOCUMENTS

2003/0124383 A1 7/2003 Akiyama et al.
2003/0142789 A1 7/2003 Harding et al.

FOREIGN PATENT DOCUMENTS

WO WO-2009-102784 A1 8/2009

OTHER PUBLICATIONS

Gay et al. "Theory of Tackiness" Physical Review Letters, vol. 82, No. 5, pp. 936-939; (1999).*

(Continued)

*Primary Examiner* — Courtney Thomas

(74) *Attorney, Agent, or Firm* — Venable, LLP; Henry J. Daley; Laura G. Remus

(57) ABSTRACT

An x-ray source for generating x-rays with at least one narrow energy band includes an enclosing vessel, a first contact arranged with a first contact surface in the enclosing vessel, a second contact arranged with a second contact surface in the enclosing vessel, and an actuator assembly operatively connected to at least one of the first and second contacts. The actuator assembly is structured to cause the first contact surface and the second contact surface to repeatedly come into contact, and separate after making contact, while in operation. The first contact surface is a surface of a first triboelectric material and the second contact surface is a surface of a second triboelectric material, the surface of the first triboelectric material having a negative triboelectric potential relative to the surface of the second triboelectric material. The second contact includes a material that includes an atomic element in its composition that has an excited quantum energy state that can be excited by electrons traveling from the first contact surface to the second contact surface such that the atomic element emits x-rays having an energy within the at least one narrow energy band upon transition from the excited state into a lower energy state. The enclosing vessel is structured to provide control of an atmospheric environment to which the first and second contact surfaces are exposed.

27 Claims, 11 Drawing Sheets

(56) References Cited

OTHER PUBLICATIONS

Ananthakrishna. Dynamics of the peel front and the nautre of acoustic emission during peeling of an adhesive tape. Phys. Rev. Lett. 97, 165503-06 (2006).
Apodaca et al., Angew. Chem. Int. Ed. 49, 946 (2010).
Autumn, K. et al. Adhesive force of a single gecko foot-hair. *Nature* 405, 681-685 (2000).
Baksht et al., Duration of the x-ray emission arising in a vacuum discharge. *Izvesiiya Uchebnykh Zavedenii., Fizika* 2, 140-141 (1973).
Black et al., The mystery of cloud electrification. American Scientist, 86, 526 (1998).
Budakian, K. Weninger, R. A. Hiller and S. P. Putterman, Nature 391, 266 (1998).
Camara, J. V. Escobar, J. R. Hird and S. P. Putterman, Appl. Phys. B 99, 613 (2010).
Camara, J. V. Escobar, J. R. Hird and S. P. Putterman, Nature 455, 1089 (2008).
Chervenak, J.G. Liuzzi, A. Experimental thick target Bremsstrahlung spectra from electrons in the range 10-30keV. *Phys. Rev. A*, 12, 26-33 (1975).
Chikina, I. Gay, C. Cavitation in adhesives. *Phys. Rev. Len*. 85, 4546-4549 (2000)).
Constable, J. Horvat and R. A. Lewis, Appl. Phys. Lett. 97, 131502 (2010).
Cortet et al., Imaging the stick-slip peeling of an adhesive tape under a constant load. J. of Stat. Mech. 3, 3-00 (2007).
Deryagin et al., Adhesion of Solids (Consultants bureau, New York, 1978).
Dickinson et al. Dynamical tribological probes: particle emission and transient electrical measurements. Tribology Lett. 3, 53-67 (1997).
Dwyer, J.R. et al. Energetic radiation produced during rocket-triggered lightning. Science 299, 694-697 (2003).
Eddingsaas, N.C. K,S, Light from sonication of crystal slurries. Nature 444, 163 (2006).
Freund et al., Electro-magnetic earthquake bursts and critical rupture of peroxy bond networks in rocks. Techtonophysics 431, 33-47 2007.
Graf von Harrach et al., Charge effects in thin film adhesion. Thin Sol. Films 12, 157-161 (1972).
Harper, Contact and, rictional electrification, (Oxford University Press, London, 1967) Abstract.
Harvey, Science 89, 460 (1939) p. 460.
Karasev, N. A. Krotova and B. W. Deryagin, Dokl. Akad. Nauk. SSR 88 777 (1953).
Kendall, K. Thin-film peeling—the elastic term. J Phys, D 8, 1449-1453 (1975).
Klyuev et al., The effect of air pressure on the parameters of x-ray emission accompanying adhesive and cohesive breaking of solids. Soy. Phys. Tech. Phys. 34, 361-364 (1989).
McCathy and G. M. Whitesides, Angew. Chem. Int. Ed. 47, 2188 (2008).
McEwan and G. I. Taylor, J. Fluid Mech. 26, 1 (1966).
Mesyats, G.A. Ectons and their role in plasma processes. Plasma Phys. Control Fusion 47,, Al 09-A151 (2005).
Mesyats, GA. Nanosecond x-ray pulses. Soy. P.hys,, Tech. Phys. 19, 948-951 (1975)).
Miura et al., Forces, charges, and light emission during the rupture of adhesive contacts. J. of Appl. Phys. 102, 103509 (2007).
Naranjo et al., Observation of nuclear fusion driven by a pyroelectric crystal, Nature 434, 1115-1117 (2005).
Obreimoff, J.W. The splitting strength of mica. Proc. Roy. Soc. 290-297 (1930).
Orville et al., Absolute spectral measurements of lightning from 375 to 880 nm, J. of the Atm. Sciences 41, 3180-3187 (1984).
Putterrnan et al., Sonoluminescence: how bubbles turn sound into light. Annual Rev. of Fluid Mech. 32, 445 (2000).
Raizer, Y. Gas Discharge Physics (Springer, Berlin Germany, 1991), pp. 132.
Shaw, Proc. R. Soc. Lond. A 94, 16 (1917).
Stoneham, Modelling Simul. Mater. Sci. Eng. 17, 084009 (2009).
Urahama, Effect of peel load on stringiness phenomena and peel speed of pressure-sensitive adhesive tape. J. of Adhesion. 31, 47-58 (1989).
Walton, A. I. Triboluminescence. Adv. in Phis. 26, 887-948 (1977).
Zosel, A. Adhesive failure and deformation behavior of polymers. J. Adhesion 30, 135 (1989).
International Search Report and Written Opinion of PCT/US2012/025851.

* cited by examiner

TRIBOELECTRIC X-RAY SOURCE

CROSS-REFERENCE OF RELATED APPLICATION

This is a national stage application under 35 U.S.C. §371 of PCT/US2012/028581 filed Mar. 9, 2012, the entire contents of which are incorporated herein by reference and that claims priority to U.S. Provisional Application No. 61/451,694 filed Mar. 11, 2011, the entire contents of which are hereby incorporated by reference.

This invention was made with government support under W81XWH-10-1-1049, awarded by United States Army Medical Research and Materiel Command. The government has certain rights in this invention.

BACKGROUND

1. Field of Invention

The field of the currently claimed embodiments of this invention relates to triboelectric x-ray sources.

2. Discussion of Related Art

Triboelectricity has been utilized in fundamental scientific research as a source of high electrostatic potential for over three centuries from the early electrostatic apparatus of Haukesbee (F. Haukesbee, *Physico-Mechanical experiments on various subjects* (London: 1709)) through to the eponymous generators of van der Graaf, yet there remains a notable absence of a first principles approach to the subject (M. Stoneham, Modelling Simul. Mater. Sci. Eng. 17, 084009 (2009)). Electrostatic generators store the integrated charge that is developed when two materials are rubbed together in frictional contact. The materials are selected to be furthest apart in the triboelectric series—an empirically derived list showing both the propensity of the materials to charge and the polarity of charge (P. E. Shaw, Proc. R. Soc. Lond. A 94, 16 (1917)). At the point of contact between the two materials, the frictional electrification may be of such magnitude that it may ionize the gas surrounding it, creating triboluminescence. The triboluminescence observed during peeling pressure sensitive adhesive (PSA) tape has long attracted scientific attention (E. N. Harvey, Science 89, 460 (1939)) and has an electrostatic origin. When the tape is peeled, charge densities $10^{12}$ e $cm^{-2}$ (where is e is the fundamental charge on the electron) are exposed on the surfaces of the freshly peeled region and subsequently discharge (C. G. Camara, J. V. Escobar, J. R. Hird and S. P. Putterman, Nature 455, 1089 (2008)). If the tape is peeled in vacuum ~10 mTorr, it has been found that the triboluminescence produced extends to X-ray energies (V. V. Karasev, N. A. Krotova and B. W. Deryagin, Dokl. Akad. Nauk. SSR 88 777 (1953)). More recently (Camara, et al., id.), it was found that there are two timescales for tribocharging during the peeling of tape in vacuo: the first, common to electrostatic generators and classic electrostatic experiments (W. R. Harper, *Contact and frictional electrification*, (Oxford University Press, London, 1967)), is the long timescale process which results in an average charge density of $10^{10}$ e $cm^{-2}$ being maintained on the surface of the tape and second, a nanosecond process with charge densities of $10^{12}$ e $cm^{-2}$. In addition, it was found that the X-ray discharge from peeling tape was sufficiently self-collimated at the peel line to resolve the inter-phlangeal spacing of a human digit. The emission of nanosecond X-ray pulses allowed an estimate of the emission region to be calculated. Subsequent research on peeling PSA tape with a width of 1.5 mm has confirmed that the process takes place at dimensions less than 300 μm (C. G. Camara, J. V. Escobar, J. R. Hird and S. P. Putterman, Appl. Phys. B 99, 613 (2010)). This result has provided the prospect of multiple-element X-ray sources consisting of sub-mm arrays powered by the triboelectric effect.

Underpinning this recent work on triboelectricity is a resurgence of interest in how charge transfer occurs between different materials and particularly between polymers. Particularly intriguing is the report of like-polymers charging each other (M. M. Apodaca, P. J. Wesson, K. J. M. Bishop, M. A. Ratner and B. A. Grzybowski, Angew. Chem. Int. Ed. 49, 946 (2010)). More fundamentally, an open question is whether the transfer particle is an ion (L. McCathy and G. M. Whitesides, Angew. Chem. Int. Ed. 47, 2188 (2008)) or an electron (Harper, id.)—a matter that is still debated despite centuries of experimental research. Whether the charge carriers responsible for tribocharging are electrons or ions, what is clear is that very large charge densities are readily generated.

For the most effective charging to occur, intimate contact between the materials and cleanliness of the contacting surfaces is important (R. Budakian, K. Weninger, R. A. Hiller and S. P. Putterman, Nature 391, 266 (1998)). While the peeling geometry of PSA tapes is mathematically elegant (A. D. McEwan and G. I. Taylor, J. Fluid Mech. 26, 1 (1966)) and meets both criteria, a disadvantage of using these for a portable X-ray device not requiring a high voltage supply is, however, the significant out-gassing that occurs during peeling off-the-shelf tape in vacuo (E. Constable, J. Horvat and R. A. Lewis, Appl. Phys. Lett. 97, 131502 (2010)). There thus remains a need for improved triboelectric x-ray sources.

SUMMARY

An x-ray source for generating x-rays with at least one narrow energy band according to an embodiment of the current invention includes an enclosing vessel, a first contact arranged with a first contact surface in the enclosing vessel, a second contact arranged with a second contact surface in the enclosing vessel, and an actuator assembly operatively connected to at least one of the first and second contacts. The actuator assembly is structured to cause the first contact surface and the second contact surface to repeatedly come into contact, and separate after making contact, while in operation. The first contact surface is a surface of a first triboelectric material and the second contact surface is a surface of a second triboelectric material, the surface of the first triboelectric material having a negative triboelectric potential relative to the surface of the second triboelectric material. The second contact includes a material that includes an atomic element in its composition that has an excited quantum energy state that can be excited by electrons traveling from the first contact surface to the second contact surface such that the atomic element emits x-rays having an energy within the at least one narrow energy band upon transition from the excited state into a lower energy state. The enclosing vessel is structured to provide control of an atmospheric environment to which the first and second contact surfaces are exposed.

An x-ray source array according to an embodiment of the current for generating an array of x-rays with at least one narrow energy band includes a plurality of triboelectric x-ray sources arranged in an arrayed pattern. Each of the plurality of triboelectric x-ray sources includes a first contact arranged with a first contact surface in an enclosing vessel, a second contact arranged with a second contact surface in the enclosing vessel, and an actuator assembly operatively connected to at least one of the first and second contacts. The actuator assembly is structured to cause the first contact surface and the second contact surface to repeatedly come into contact, and separate after making contact, while in operation. The first contact surface is a surface of a first triboelectric material and the second contact surface is a surface of a second triboelectric material. The surface of the first triboelectric material has a negative triboelectric potential relative to the surface of the second triboelectric material. The second contact includes a material that includes an atomic element in its composition that has an excited quantum energy state that can be excited by electrons traveling from the first contact surface to the second contact surface such that the atomic element emits x-rays having an energy within the at least one narrow energy band upon transition from the excited state into a lower energy state. The enclosing vessel is structured to provide control of an atmospheric environment to which the first and second contact surfaces are exposed.

BRIEF DESCRIPTION OF THE DRAWINGS

Further objectives and advantages will become apparent from a consideration of the description, drawings, and examples.

DETAILED DESCRIPTION

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification, including the Background and Detailed Description sections, are incorporated by reference as if each had been individually incorporated.

Some embodiments of the current invention can provide an inexpensive X-ray source which does not require a high voltage power supply. In one embodiment, it comprises two triboelectric materials repeatedly brought in and out of contact in a vacuum using an actuator (e.g., a device which uses piezoelectricity, electromechanical force, magnetostriction, or human energy to effect motion). One material is the cathode, which can be, but is not limited to, a polymer or monomer (such as silicone, vinyl, latex, EPDM, Teflon etc.). The second material provides the anode and is either from a metal, or a plastic, a ceramic, a polymer, a monomer, or an epoxide, for example, which is loaded with metallic material so as to increase bremsstrahlung efficiency and to generate characteristic X-ray lines. The device can be used for X-ray imaging, elemental analysis and spectroscopy, for example, and may open up new possibilities in the many fields in which X-rays are used.

There are many benefits of some embodiments of the current invention over a system incorporating PSA tape. For example, the geometry may be changed to increase the electric field or to produce a shaped source of X-rays; outgassing in the vacuum can be reduced; the X-ray spectrum can be controlled to produce characteristic lines of elements; the contacting surfaces may be designed to promote a more rapid electrical discharge; the device can be further miniaturized and individual elements can be arranged into arrays. The x-ray emission can be controlled by the contact repetition rate, the gas composition and pressure, the temperature, the contact stress, the surface roughness, the surface stiffness.

Devices according to some embodiments of the current invention can find application where X-rays are used and could open up new market areas. Applications can include medical imaging situations where cost or lack of power supply in remote locations is an issue. Other areas of application can include X-ray fluorescence and elemental analysis in geology or material science, etc. However, the broad concepts of the current invention are not limited to these particular examples.

Figure 1:
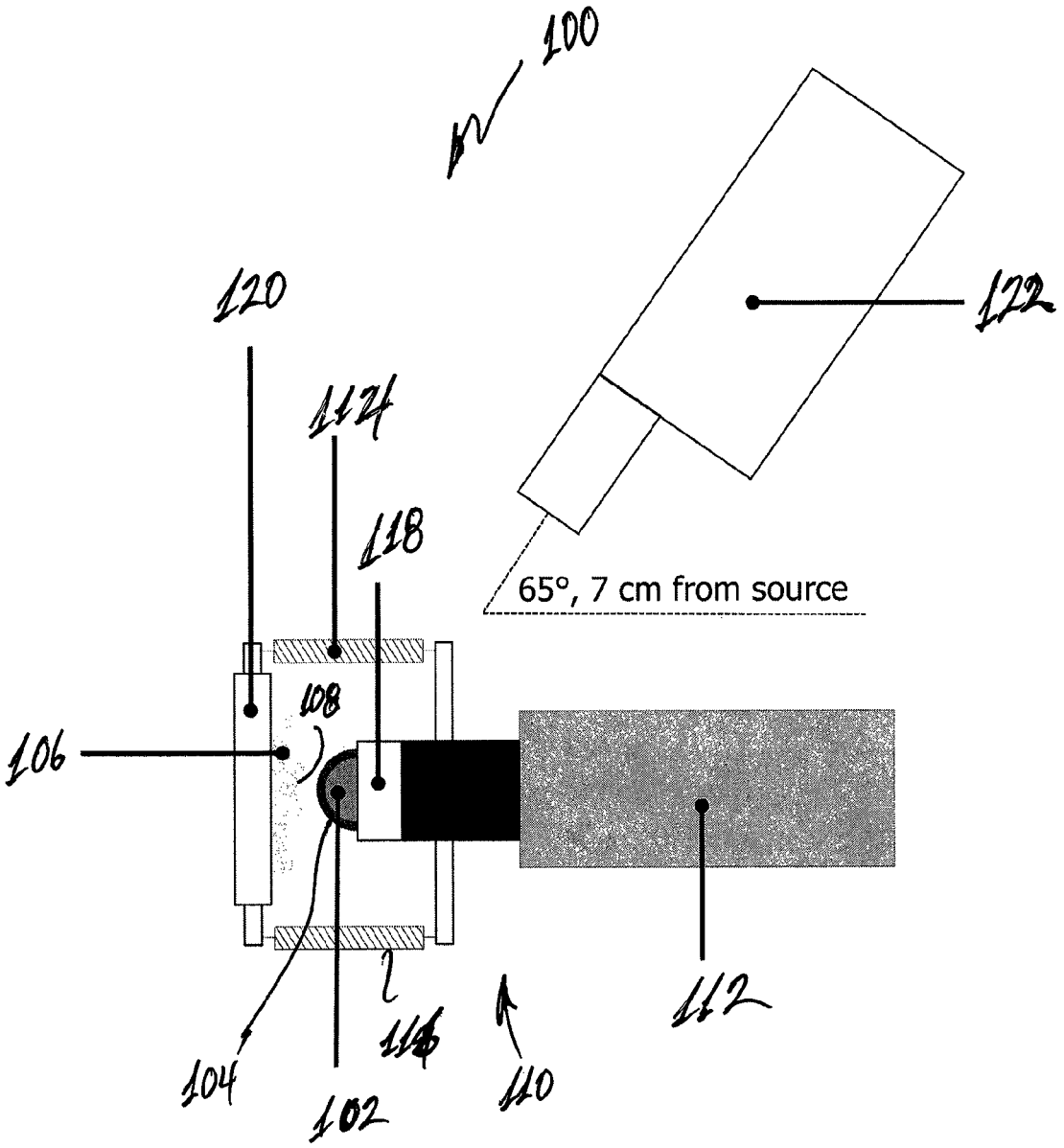
FIG. 1 is a schematic illustration of an X-ray source according to an embodiment of the current invention. This apparatus brings a silicone rod and epoxy substrate in and out of contact. Epoxy substrate 106 is 3.5 mm thick with an imprint of the cylindrical silicone rod 102 having a diameter of ~10 mm. The silicone is attached to the solenoid 112 by means of pins to a Teflon mount 118. The armature of the solenoid is pulled by two extension springs 114, 116 into the epoxy substrate which is mounted on a Teflon block 120. A solid state X-ray detector 122 is placed at a distance of 7 cm from the source at 65 degrees. The separation between 106 and 102 could be varied between 0 mm and 5 mm and it was found that the device could operate at up to 20 Hz.

FIG. 1 is a schematic illustration of an X-ray source 100 for generating X-rays with at least one narrow energy band according to an embodiment of the current invention. The X-ray source 100 includes an enclosing vessel (not shown in FIG. 1), a first contact 102 arranged with a first contact surface 104 in the enclosing vessel, a second contact 106 arranged with a second contact surface 108 in the enclosing vessel, and an actuator assembly 110 operatively connected to at least one of the first contact 102 and the second contact 106. The actuator assembly 110 is structured to cause the first contact surface 104 and the second contact surface 108 to repeatedly come into contact, and separate after making contact, while in operation. The first contact surface 104 is a surface of a first triboelectric material and the second contact surface 108 is a surface of a second triboelectric material. The surface of the first triboelectric material has a negative triboelectric potential relative to the surface of the second triboelectric material while the X-ray source is in operation. The second contact 106 includes a material with an atomic element in its composition that has an excited quantum energy state that can be excited by electrons traveling from the first contact surface 104 to the second contact surface 108. The atomic element emits X-rays having an energy within the at least one narrow energy band upon transition from the excited state into a lower energy state. The enclosing vessel is structured to provide control of an atmospheric environment to which the first and second contact surfaces are exposed.

The term "narrow energy band" of X-rays refers to the type of X-rays emitted by transitions between quantized energy levels, such as between atomic electron energy levels. Some broadening of the energy band is intended to be included within the definition of "narrow energy band", such as, but not limited to Doppler broadening. This can also include a fine structure in the narrow energy band, such as when the atoms that emit the x-rays are in a magnetic field. This can include, but is not limited to, K-lines. It can also include L-lines and/or other transition lines.

The atomic element can have a plurality of excited quantum energy states that can be excited by electrons traveling from the first contact surface to the second contact surface in some embodiments of the current invention. The atomic element in this case emits x-rays having an energy within a plurality of narrow energy bands upon transition from the plurality of excited quantum energy states into lower energy states.

In some embodiments, the second contact 106 includes a material with a plurality of atomic elements, each of which has an excited quantum energy state that can be excited by electrons traveling from the first contact surface 104 to the second contact surface 108. In this case, the plurality of atomic elements emit x-rays that have an energy within respective narrow energy bands upon transition from each respective excited quantum energy state into a corresponding lower energy state. In other words, a particular atomic element may provide a plurality of useful X-ray lines for some applications. In other applications, two, three, four, or more atomic elements can be used in the second contact 106 to provide a multiline source.

The K-lines of atomic elements increase roughly as the square of Z−1, where Z is the atomic number. Therefore, for applications in which higher energy narrow band sources are needed, one can consider atomic elements with higher atomic number Z to be include in the second contact 106. For example, in some applications an atomic element that has an atomic number Z of at least 13 may be desirable. In some embodiments, the material that includes the atomic element that emits the narrow band of X-rays can be the second triboelectric material. For example, the second contact 106 can be a metal contact in some embodiments. One example that can be suitable for some applications is using lead (Pb) for the second contact 106. However, the broad concepts of the current invention are not limited to these examples. In other embodiments, one can select the second triboelectric material based on its triboelectric and/or other properties and select an additional material that has an atomic element that provides the desired narrow band of X-rays. Other properties of the materials can be practical properties, such as cost, safety, manufacturability, ability to be combined with materials containing the desired atomic elements, etc. For example, in some applications, the second triboelectric material can be an epoxy and the material that has the atomic element can be a metal. In some embodiments, a polymer has been found to be suitable for the first triboelectric material. However, the broad concepts of the current invention are not limited to these particular examples.

In some embodiments, the first triboelectric material and the second triboelectric material are selected to provide a charge density of at least $10^{10}$ electrons per $cm^{-2}$ across the first contact surface.

The actuator assembly 110 can include at least one of an electrical, a hydraulic or a pneumatic system for causing the first contact surface and the second contact surface to repeatedly come into contact and separate after making contact. Some particular embodiments of actuator assemblies will be described in more detail below. However, the invention is not limited to these particular examples.

As noted above, some embodiments of the current invention can provide a simple triboelectric powered X-ray source that does not utilize PSA tape. We now describe a particular embodiment in more detail. The X-ray source 100, illustrated in FIG. 1, includes a 12 V DC 'pull type' solenoid 112 and associated driver which is activated by a TTL pulse from a delay generator (SRS DG535). A cylinder of smooth silicone rubber (1.6 mm thick; 60 A durometer) is formed around a silicone rod (diameter 8 mm) and mounted on the end of the solenoid armature to form a hammer (cylindrical radius of ~5 mm) to provide first contact 102. The hammer impacts a piece of 3.5 mm thick cast epoxy (Devcon No. 14270) by means of extension springs 112, 114 that pull the armature away from the body of the solenoid 112 so that silicone-epoxy contact is made. Prior to mounting, the silicone is sonicated in ethyl-alcohol in an attempt to clean the surface. To ensure a good contact with the epoxy substrate, a thin film of epoxy (of similar composition) is applied to the substrate before allowing it to come into contact with the substrate. This is left to dry for 15 minutes. The epoxy does not adhere to the silicone and so, when separated, the silicone forms a cylindrical relief slightly proud of the substrate. The contact has an apparent contact area of 64±5 $mm^2$ (second contact surface 108).

It was found that powdered elemental metals could be added to the epoxy without eliminating the triboelectric charging behavior of the epoxy binder. The addition of molybdenum (1 μm-2 μm) and silver (400 mesh) powders are used in the examples below. The epoxy substrates were simultaneously cast and weighed in a polystyrene weighing dish using epoxy that was dispensed using an applicator gun and mixer nozzle. If metallic filler was used, this would first be weighed before epoxy was added and thoroughly mixed using a wooden stirrer.

The apparatus was mounted in a vacuum chamber that was evacuated by a turbomolecular pump backed by a dry pump. The vacuum pressure was measured using a pirani gauge (SRS PG105) and controller (SRS IGC100) calibrated for $N_2$. A bleed valve on the vacuum chamber allowed the pressure to be varied. The X-rays were detected using a solid state X-ray detector (Amptek XR-100T-CdTe) having a 25 $mm^2$ detector area and an efficiency approaching 100% in the range 10 keV to 60 keV. This was placed outside of the chamber behind a 6 mm polycarbonate window (not corrected for). The output signal of its associated amplifier (Amptek PX2T-CdTe) was recorded at 1 M sample $s^{-1}$ by an acquisition board (NI PXI-1033) and stored to disk before analysis was performed. The data acquisition board was triggered using the solenoid TTL trigger. Unless otherwise stated, the collection time for all data presented in this experiment was 60 s and the detector was 7 cm away from the center of the source. Using this apparatus, we have investigated the production and spectra of X-rays at vacuum pressures between $10^{-3}$ Torr and $10^{-2}$ Torr, at separations between 2.5 mm and 5 mm and at repetition rates between 1 Hz and 20 Hz.

Figure 2:
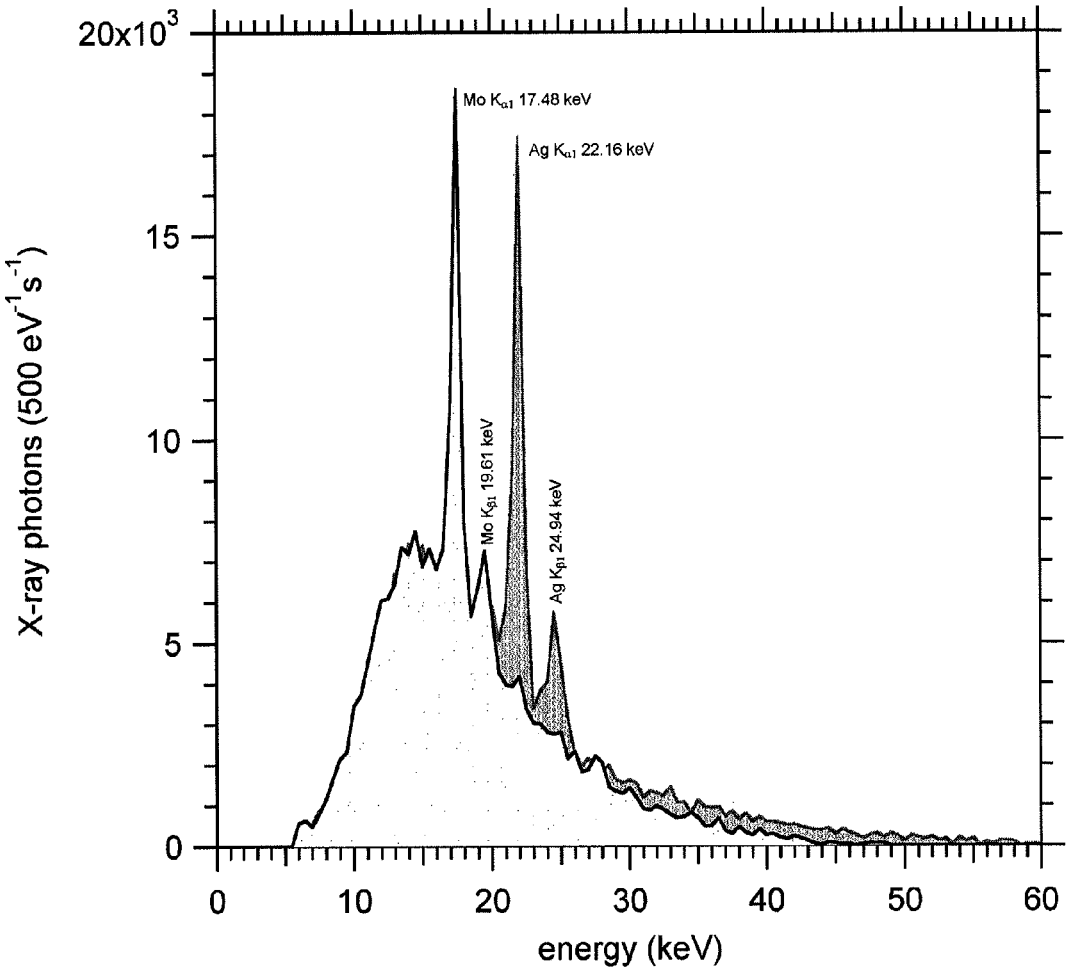
FIG. 2 shows X-ray emission spectra of the device of FIG. 1 operated at 1 Hz for 60 secs using molybdenum (light) or silver (shaded) loaded epoxy in contact with silicone rubber. The maximum separation was 5 mm. The resolution of the spectra are instrument limited.

FIG. 2 shows the resulting X-ray spectra from loading the epoxy with silver and molybdenum clearly showing characteristic K-lines of molybdenum ($K_{\alpha 1}$ 17.48 keV, $K_{\beta 1}$ 19.61 keV) and of silver ($K_{\alpha 1}$ 22.16 keV, $K_{\beta 1}$ 24.94 keV). The resolution of these lines is instrument limited (~400 eV) so it is not possible to resolve the $K_{\alpha 2,3}$ $K_{\beta 2,3}$ components. For the silver spectrum shown, a flux of $2.43\times10^5$ X-ray photons $s^{-1}$ was emitted into $2\pi$. Of these, 9% have energies ranging between 20.5 keV and 23 keV.

Figure 3:
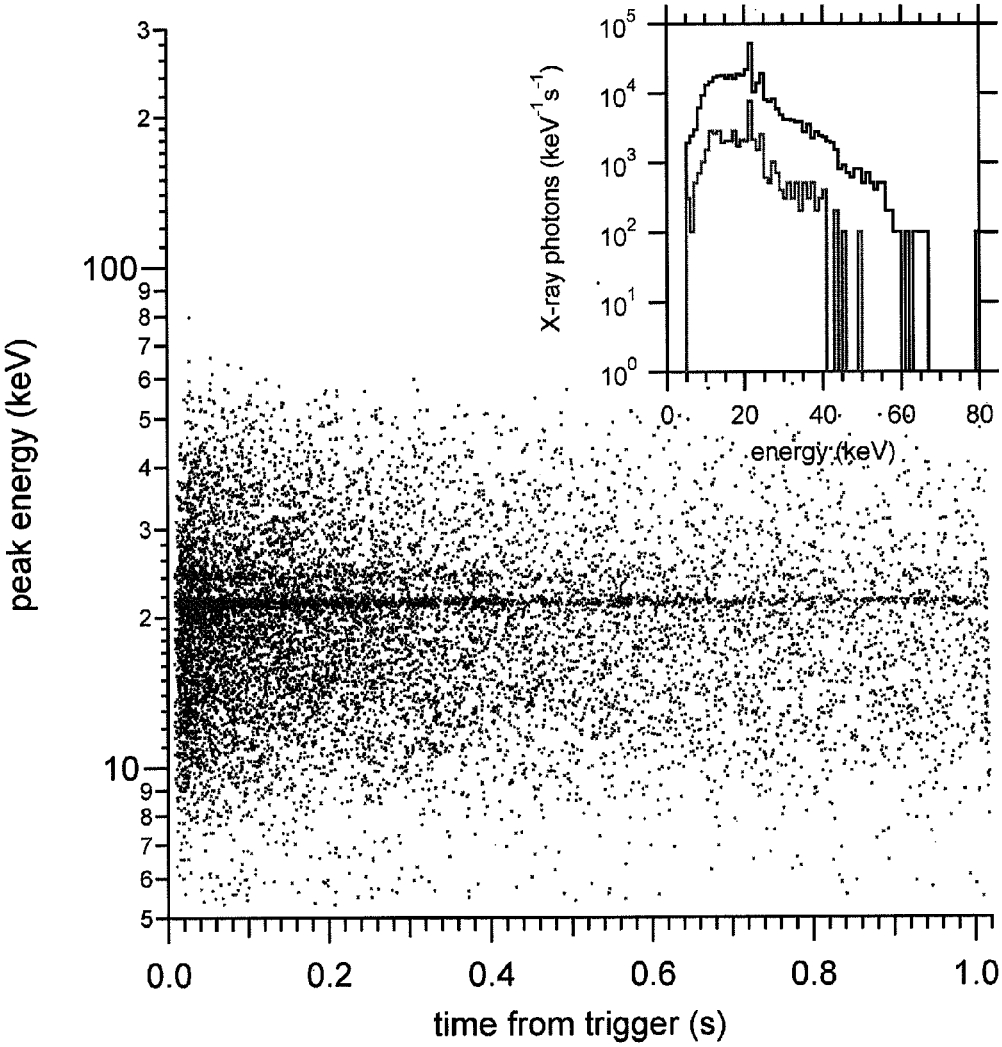
FIG. 3 shows individual X-ray photons plotted as a function of time of arrival when the device of FIG. 1 (silicone-Ag-epoxy system) is operated at 0.5 Hz, a separation of 5 mm and at 1 mTorr. X-rays are continually emitted throughout the open cycle and are of sufficient intensity to excite the Ag K-lines for >1 s. Inset: The spectra of the first 100 ms (black) and last 100 ms (shaded) emitted photons show no spectral differences over the full cycle.

The emergence of the K-lines from the bremsstrahlung is an unambiguous demonstration that the silicone charges negatively with respect to epoxy, since the metal-loaded epoxy must act as the electron target or anode. Although displacement between the contacting surfaces was not directly measured, an examination of the data showed that at the maximum cycle frequency used (20 Hz), the duration of the emission almost exactly corresponded to the time that the silicone and epoxy were separated; implying that the maximum separation was reached in a time much less than 25 ms. The addition of high-Z materials to the epoxy should also increase the probability and efficiency of the emission. While experimental variations did not permit a full investigation of this prediction, it is worth mentioning that the maximum X-ray flux we have recorded (~$8\times10^5$ X-rays $s^{-1}$) were in experiments conducted with a tungsten filler. At the lowest gas vacuum pressures used (1 mTorr), it was found that the X-ray emission decayed over several seconds (FIG. 3) and that there was no significant spectral difference other than an order of magnitude loss of intensity (FIG. 3 inset). The presence of the Ag $K_{\alpha 1,\beta 1}$ lines throughout the separation of the cycle is a striking demonstration of the energetics involved in the process and shows that a potential of 40 kV still exists after 1 second of discharge. If the maximum kinetic energy of the electrons in the field created by the silicone and epoxy is assumed to be 40 kV at the end of each open cycle, and additionally that the contact can be approximated by parallel charged plates of 64 $mm^2$, then the final charge density $\sigma_f$ at a separation of 5 mm is $4.4\times10^{10}$ e $cm^{-2}$. For the experiment shown in FIG. 3, a flux of $1.26\times10^5$ X-ray photons $s^{-1}$ was recorded (corresponding to $2.52\times10^5$ per open cycle). If the bremsstrahlung efficiency of the metal-filled epoxy is ~$10^{-4}$, then the initial charge density, $\sigma_i$, is $4.6\times10^{10}$ e $cm^{-2}$—only marginally larger than that on the surface at the end of the cycle.

Figure 4:
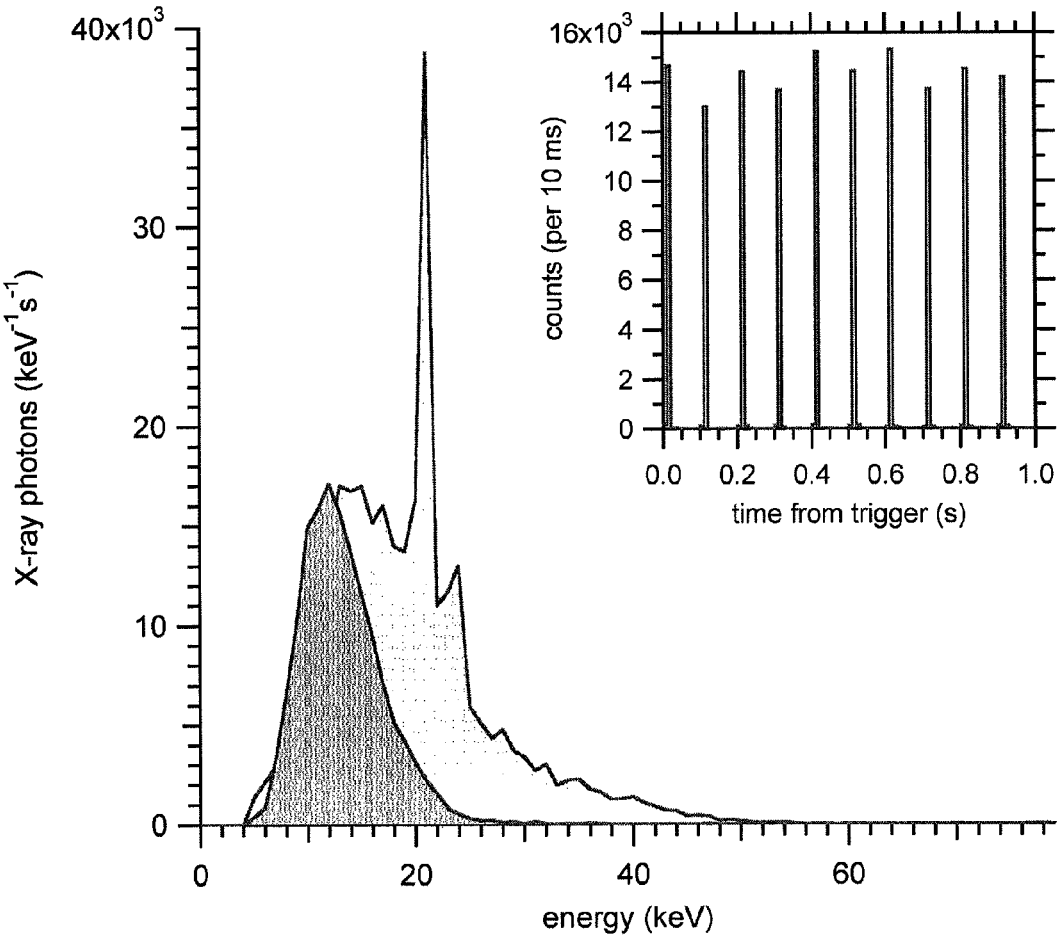
FIG. 4 shows X-ray emission spectra of Ag-loaded epoxy as a function of pressure with the device of FIG. 1 operated at 10 Hz. Changing the vacuum pressure from 1 mTorr (light) to 30 mTorr (shaded) results in a change of spectrum and a notable absence of the Ag K-lines at the higher pressures. Inset: Histogram of X-ray photons recorded over 1 s at a vacuum pressure of 30 mTorr showing the temporal narrowing of the X-ray emission.

As the vacuum pressure was raised, it was found that it was possible to change both the spectral envelope (FIG. 4) and the timing of the X-ray burst (FIG. 4: inset). The long X-ray emission times which characterize the system at 1 mTorr (FIG. 3) can be shortened so that the temporal duration of the pulse narrowed to less than 10 ms. These bursts occurred as the epoxy-silicone initially separated. It was found that the optimal pressure for this narrowing to occur varied between experiments, but was usually found between 20 mTorr and 30 mTorr. At a temperature of 296 K and a pressure of 30 mTorr (4 N $m^{-2}$), the mean free path of an electron is calculated to be ~8 mm—the same order of magnitude as the plate separation (2.5 mm)—suggesting that interactions with gas molecules play an increasing role in the mechanism.

Figure 5:
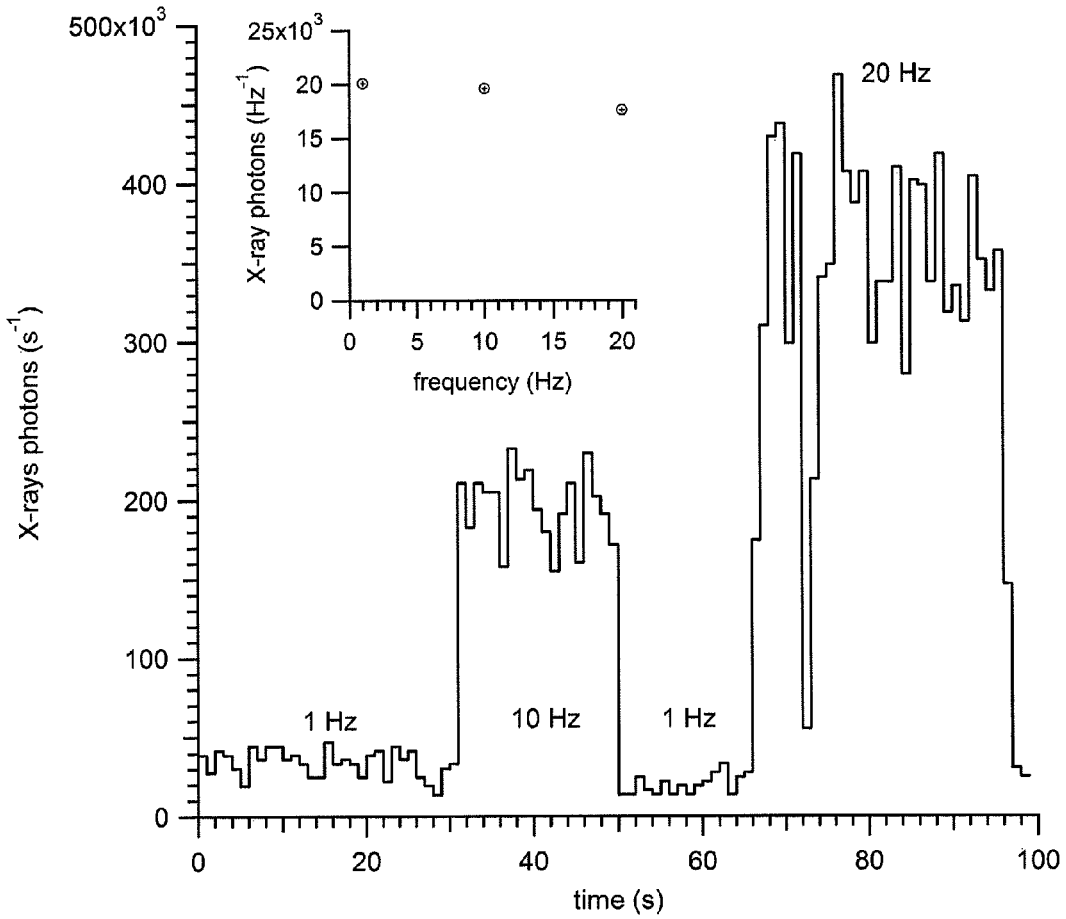
FIG. 5 shows X-ray flux at different repetition rates for the Ag-Epoxy-silicone system operated at a pressure of 20 mTorr. Inset: The scaling between short sample times is approximately linear.

A characteristic decay of the device was found which appeared to depend on both the pressure and the number of contacting cycles. Despite this, it was found that the cycle frequency could be increased to enact an almost linear scaling up to 20 Hz when the timescales between successive sampling intervals was short. FIG. 5 shows the number of X-ray photons recorded per second when the system is run at 1 Hz, 10 Hz and 20 Hz. The inset to FIG. 5 is a plot of the average number of X-ray photons per contacting cycle for the 10 Hz, 1 Hz, 20 Hz sequence shown.

A simple X-ray source that uses the triboelectric effect instead of a high voltage power supply was demonstrated in this example according to an embodiment of the current invention. During repeated contact between a metal-loaded epoxy and silicone rubber, electrical charge is transferred, rendering the silicone more negative than the epoxy. The resulting charge imbalance creates an electric field able to accelerate excess electrons towards the metal filled-epoxy creating strong characteristic X-ray lines and bremsstrahlung radiation. A surprising observation is that the field is maintained over relatively long timescales. At higher pressures, the X-ray intensity scales linearly with cycle frequency up to 20 Hz suggesting that the only limitation to achieving a realistic device having $10^8$ photons $s^{-1}$ is finding an actuator capable of mm displacements that can be operated at frequencies of at least 500 Hz. Piezoelectric bimorph actuators may be suitable for such operation.

Figure 6:
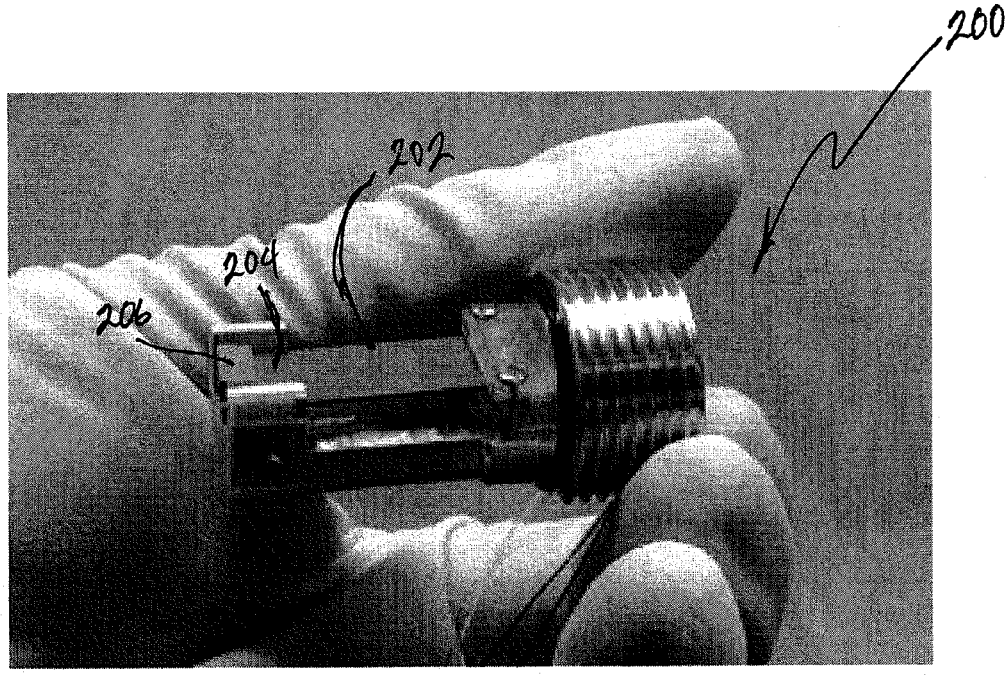
FIG. 6 shows an X-ray source according to another embodiment of the current invention.
Figure 7:
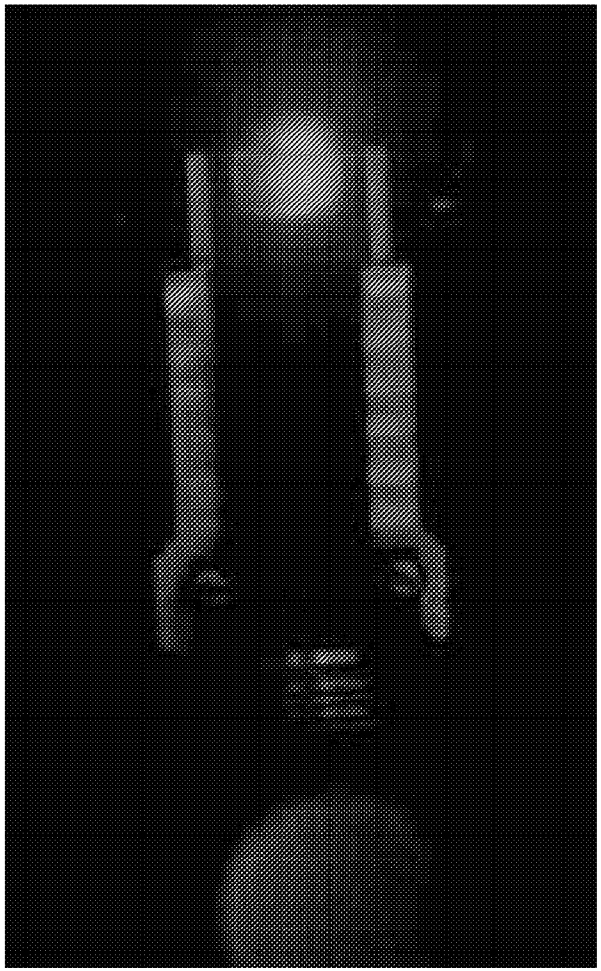
FIG. 7 is a photograph showing the device of FIG. 6 operating in a low pressure neon atmosphere.

FIG. 6 shows an X-ray source 200 according to another embodiment of the current invention. Again, the enclosing vessel is not shown for clarity in viewing the inner structures. In use, the X-ray source 200 will be enclosed in an enclosing vessel in order to provide a vacuum. The enclosing vessel can have a window portion that is more transparent to the X-rays produced that other portions. The X-ray source 200 has a cantilever 202 that is driven by a piezoelectric transducer. There is a thin silicone membrane 204 on the cantilever 202 to provide the first contact. An epoxy contact 206 has metal particles mixed in it to provide the second contact. FIG. 7 is a photograph demonstrating the device 200 in operation in which there is a low pressure neon gas atmosphere within the enclosing vessel which provides the characteristic red-orange glow of neon discharge.

Figure 8:
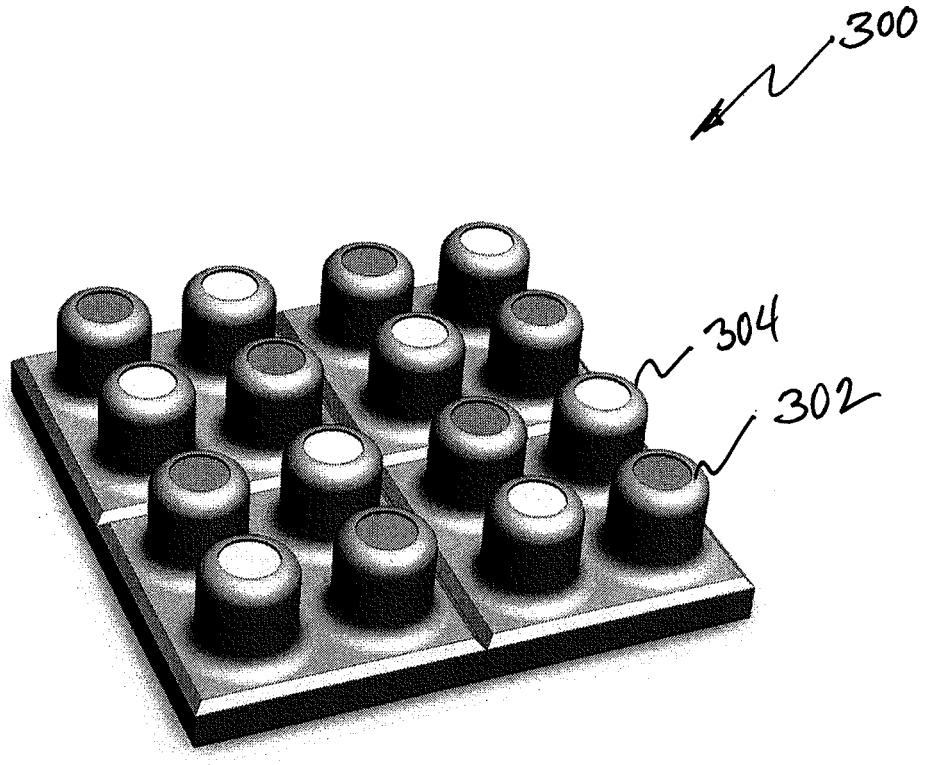
FIG. 8 is a schematic illustration of an X-ray array source according to an embodiment of the current invention.
Figure 9:
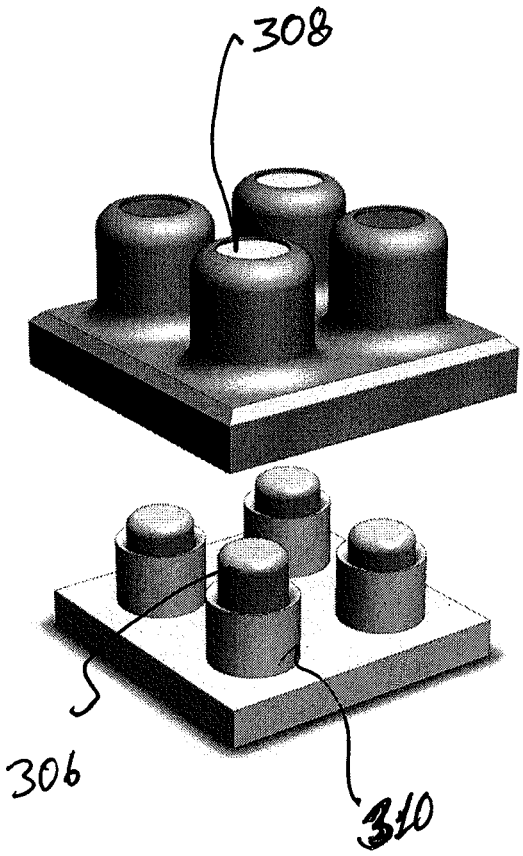
FIG. 9 is a schematic illustration of a quadrant of the X-ray array source of FIG. 8 in an exploded view.
Figure 10:
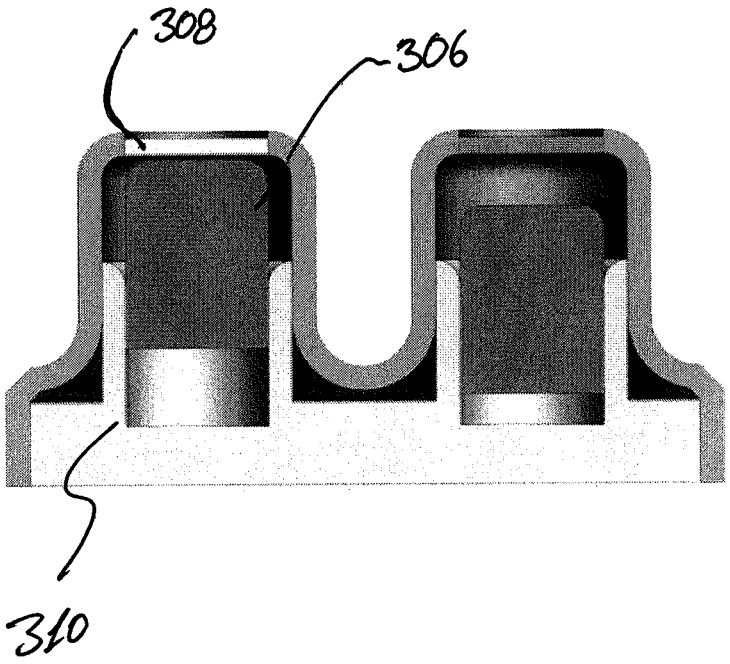
FIG. 10 is a schematic illustration of a cross-sectional view of two triboelectric X-ray sources in the X-ray array source of FIG. 8.

FIG. 8 is a schematic illustration of an X-ray source array 300 for generating an array of X-rays with at least one narrow energy band according to an embodiment of the current invention. The X-ray source array 300 includes a plurality of triboelectric X-ray sources, such as triboelectric X-ray source 302 and triboelectric X-ray source 304, arranged in an arrayed pattern. Only two of the triboelectric X-ray sources are labeled with references numerals, for clarity. The array 300 has a total of sixteen triboelectric X-ray sources. Each of the sixteen triboelectric X-ray sources in the X-ray source array 300 are enclosed within separate enclosing vessels which are in turn connected together in this embodiment. Each of the plurality of triboelectric X-ray sources includes a first contact 306 arranged with a first contact surface in an enclosing vessel, a second contact 308 arranged with a second contact surface in said enclosing vessel, and an actuator assembly 310 operatively connected to at least one of the first contact 306 and second contact 308. (See FIGS. 9 and 10.) Each of the separate triboelectric X-ray sources in the array can be constructed and operate as in the embodiments described above. FIG. 9 is an exploded view of a quadrant of the array 300 illustrated in FIG. 8. FIG. 10 is a cross-sectional view of two adjacent triboelectric X-ray sources which provides a clearer view in the structure of the enclosing vessels.

Each of the triboelectric X-ray sources in the X-ray source array 300 can be thought of in analogy to a color video display. Each source can provide one or more narrow bands of X-rays of a selected energy (or frequency), thus, in a sense, being an X-ray "color" pattern of emission.

Figures 11A, 11B:
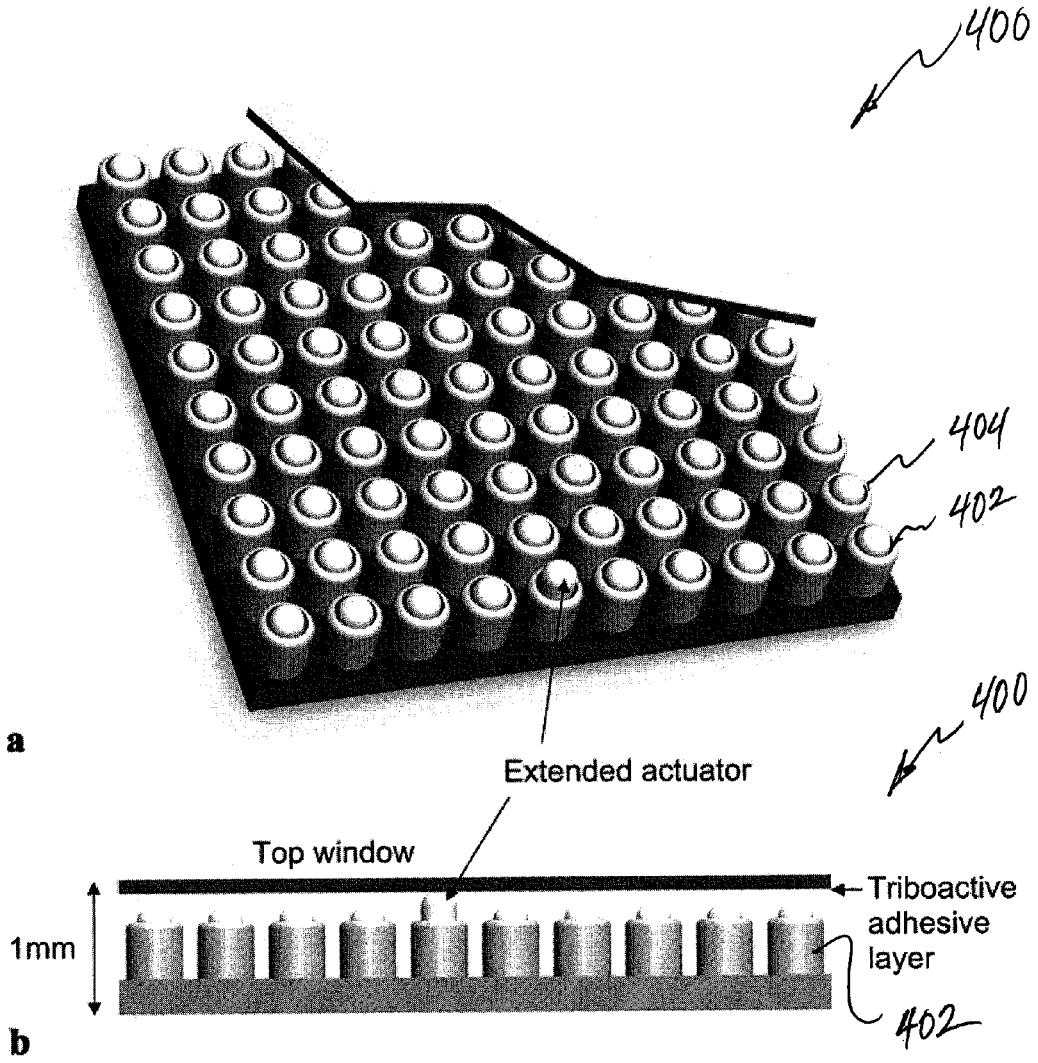
FIG. 11A is a schematic illustration of an X-ray array source according to another embodiment of the current invention in partially cut-away, perspective view.
FIG. 11B is a schematic illustration of the X-ray array source of FIG. 11A with a side of the enclosing vessel removed.

FIGS. 11A and 11 is a schematic illustration of an X-ray source array 400 for generating an array of X-rays with at least one narrow energy band according to another embodiment of the current invention. The X-ray source array 400 includes a plurality of triboelectric X-ray sources, such as triboelectric X-ray source 402 and triboelectric X-ray source 404, arranged in an arrayed pattern. This embodiment is similar to the embodiment of FIGS. 8-10 except that all of the plurality of triboelectric X-ray sources are enclosed within a common enclosing vessel.

The embodiments illustrated and discussed in this specification are intended only to teach those skilled in the art how to make and use the invention. In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. An x-ray source for generating x-rays with at least one narrow energy band, comprising:

an enclosing vessel;

a first contact arranged with a first contact surface in said enclosing vessel;

a second contact arranged with a second contact surface in said enclosing vessel; and an actuator assembly operatively connected to at least one of said first and second contacts, wherein said actuator assembly is structured to cause said first contact surface and said second contact surface to repeatedly come into contact, and separate after making contact, while in operation, wherein said first contact surface is a surface of a first triboelectric material and said second contact surface is a surface of a second triboelectric material, said surface of said first triboelectric material having a negative triboelectric potential relative to said surface of said second triboelectric material, wherein said second contact comprises a material comprising an atomic element in its composition that has an excited quantum energy state that can be excited by electrons traveling from said first contact surface to said second contact surface, wherein said atomic element emits x-rays having an energy within said at least one narrow energy band upon transition from said excited state into a lower energy state, and wherein said enclosing vessel is structured to provide control of an atmospheric environment to which said first and second contact surfaces are exposed.

2. An x-ray source for generating x-rays with at least one narrow energy band according to claim 1, wherein said atomic element has a plurality of excited quantum energy states that can be excited by electrons traveling from said first contact surface to said second contact surface, wherein said atomic element emits x-rays having an energy within a plurality of narrow energy bands upon transition from said plurality of excited quantum energy states into lower energy states.

3. An x-ray source for generating x-rays with at least one narrow energy band according to claim 1, wherein said second contact comprises a material comprising a plurality of atomic elements, each of which has an excited quantum energy state that can be excited by electrons traveling from said first contact surface to said second contact surface, wherein said plurality of atomic elements emit x-rays having an energy within respective narrow energy bands upon transition from each respective excited quantum energy state into a corresponding lower energy state.

4. An x-ray source for generating x-rays with at least one narrow energy band according to claim 1, wherein said atomic element has an atomic number Z of at least 13.

5. An x-ray source for generating x-rays with at least one narrow energy band according to claim 1, wherein said material comprising said atomic element is said second triboelectric material.

6. An x-ray source for generating x-rays with at least one narrow energy band according to claim 1, wherein said second triboelectric material and said material comprising said atomic element are different materials forming at least one of a mix, a blend, a composite or a layered structure of said materials.

7. An x-ray source for generating x-rays with at least one narrow energy band according to claim 6, wherein said second triboelectric material is an epoxy and said material comprising said atomic element is a metal.

8. An x-ray source for generating x-rays with at least one narrow energy band according to claim 7, wherein said first triboelectric material is a polymer.

9. An x-ray source for generating x-rays with at least one narrow energy band according to claim 6, wherein said first triboelectric material and said second triboelectric material are selected to provide a charge density of at least $10^{10}$ electrons per $cm^{-2}$ across said first contact surface.

10. An x-ray source for generating x-rays with at least one narrow energy band according to claim 1, wherein said actuator assembly comprises at least one of an electrical, a hydraulic or a pneumatic system for causing said first contact surface and said second contact surface to repeatedly come into contact and separate after making contact.

11. An x-ray source for generating x-rays with at least one narrow energy band according to claim 1, wherein said actuator assembly comprises a solenoid for causing said first contact surface and said second contact surface to repeatedly come into contact and separate after making contact.

12. An x-ray source for generating x-rays with at least one narrow energy band according to claim 1, wherein said actuator assembly comprises a piezoelectric actuator coupled to a cantilever, said cantilever having one of said first triboelectric material or said second triboelectric material thereon.

13. An x-ray source array for generating an array of x-rays with at least one narrow energy band, said x-ray source array comprising a plurality of triboelectric x-ray sources arranged in an arrayed pattern, wherein each of said plurality of triboelectric x-ray sources comprise:

a first contact arranged with a first contact surface in an enclosing vessel;

a second contact arranged with a second contact surface in said enclosing vessel; and an actuator assembly operatively connected to at least one of said first and second contacts, wherein said actuator assembly is structured to cause said first contact surface and said second contact surface to repeatedly come into contact, and separate after making contact, while in operation, wherein said first contact surface is a surface of a first triboelectric material and said second contact surface is a surface of a second triboelectric material, said surface of said first triboelectric material having a negative triboelectric potential relative to said surface of said second triboelectric material, wherein said second contact comprises a material comprising an atomic element in its composition that has an excited quantum energy state that can be excited by electrons traveling from said first contact surface to said second contact surface, wherein said atomic element emits x-rays having an energy within said at least one narrow energy band upon transition from said excited state into a lower energy state, and wherein said enclosing vessel is structured to provide control of an atmospheric environment to which said first and second contact surfaces are exposed.

14. An x-ray source array according to claim 13, wherein at least two of said plurality of triboelectric x-ray sources have different narrow energy bands of x-rays.

15. An x-ray source array according to claim 13, further comprising a enclosing vessel to contain all of said plurality of triboelectric x-ray sources therein.

16. An x-ray source array according to claim 13, further comprising a plurality of enclosing vessels to contain each of said plurality of triboelectric x-ray sources in a corresponding enclosing vessel.

17. An x-ray source array according to claim 13, wherein said atomic element has a plurality of excited quantum energy states that can be excited by electrons traveling from said first contact surface to said second contact surface, wherein said atomic element emits x-rays having an energy within a plurality of narrow energy bands upon transition from said plurality of excited quantum energy states into lower energy states.

18. An x-ray source array according to claim 13, wherein said second contact comprises a material comprising a plurality of atomic elements, each of which has an excited quantum energy state that can be excited by electrons traveling from said first contact surface to said second contact surface, wherein said plurality of atomic elements emit x-rays having an energy within respective narrow energy bands upon transition from each respective excited quantum energy state into a corresponding lower energy state.

19. An x-ray source array according to claim 13, wherein said atomic element has an atomic number Z of at least 13.

20. An x-ray source array according to claim 13, wherein said material comprising said atomic element is said second triboelectric material.

21. An x-ray source array according to claim 13, wherein said second triboelectric material and said material comprising said atomic element are different materials forming at least one of a mix, a blend, a composite or a layered structure of said materials.

22. An x-ray source array according to claim 21, wherein said second triboelectric material is an epoxy and said material comprising said atomic element is a metal.

23. An x-ray source array according to claim 22, wherein said first triboelectric material is a polymer.

24. An x-ray source array according to claim 21, wherein said first triboelectric material and said second triboelectric material are selected to provide a charge density of at least $10^{10}$ electrons per $cm^{-2}$ across said first contact surface.

25. An x-ray source array according to claim 13, wherein said actuator assembly comprises at least one of an electrical, a hydraulic or a pneumatic system for causing said first contact surface and said second contact surface to repeatedly come into contact and separate after making contact.

26. An x-ray source array according to claim 13, wherein said actuator assembly comprises a solenoid for causing said first contact surface and said second contact surface to repeatedly come into contact and separate after making contact.

27. An x-ray source array according to claim 13, wherein said actuator assembly comprises a piezoelectric actuator coupled to a cantilever, said cantilever having one of said first triboelectric material or said second triboelectric material thereon.

* * * * *